US009163794B2

(12) United States Patent
Simon et al.

(10) Patent No.: US 9,163,794 B2
(45) Date of Patent: Oct. 20, 2015

(54) POWER SUPPLY ASSEMBLY FOR LED-BASED LIGHT TUBE

(71) Applicant: iLumisys, Inc., Troy, MI (US)

(72) Inventors: David Simon, Grosse Pointe Woods, MI (US); John Ivey, Farmington Hills, MI (US); James Amrine, Ann Arbor, MI (US); Ryan Meganck, Troy, MI (US)

(73) Assignee: iLumisys, Inc., Troy, MI (US)

( * ) Notice: Subject to any disclaimer, the term of this patent is extended or adjusted under 35 U.S.C. 154(b) by 162 days.

(21) Appl. No.: 13/935,592

(22) Filed: Jul. 5, 2013

(65) Prior Publication Data

US 2014/0009926 A1 Jan. 9, 2014

Related U.S. Application Data

(60) Provisional application No. 61/668,720, filed on Jul. 6, 2012.

(51) Int. Cl.

| | |
|---|---|
| ***F21S 4/00*** | (2006.01) |
| ***F21K 99/00*** | (2010.01) |
| ***F21V 17/12*** | (2006.01) |
| ***F21V 17/16*** | (2006.01) |

(Continued)

(52) U.S. Cl.

CPC . *F21S 4/008* (2013.01); *F21K 9/17* (2013.01); *F21V 17/12* (2013.01); *F21V 17/164* (2013.01); *F21V 23/02* (2013.01); *F21V 3/02* (2013.01); *F21V 19/004* (2013.01); *F21V 29/507* (2015.01); *F21V 29/70* (2015.01); *F21Y 2101/02* (2013.01); *F21Y 2103/003* (2013.01)

(58) Field of Classification Search

CPC ..... F21Y 2103/003; F21Y 2105/001

USPC ..... 362/222, 217.13, 219, 249.02

See application file for complete search history.

(56) References Cited

U.S. PATENT DOCUMENTS

| | | | |
|---|---|---|---|
| D79,814 | S | 11/1929 | Hoch |
| D80,419 | S | 1/1930 | Kramer |

(Continued)

FOREIGN PATENT DOCUMENTS

| | | | |
|---|---|---|---|
| CN | 1584388 | A | 2/2005 |
| CN | 2766345 | Y | 3/2006 |

(Continued)

OTHER PUBLICATIONS

PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.

(Continued)

*Primary Examiner* — Evan Dzierzynski

(74) *Attorney, Agent, or Firm* — Young, Basile, Hanlon & MacFarlane, P.C.

(57) ABSTRACT

An LED-based light for replacing a fluorescent light in a light fixture comprises: an elongate housing, the housing having a first longitudinal portion with a first cross section and a second longitudinal portion adjoining the first longitudinal portion with a second cross section, wherein a shape of the first cross section is different from a shape of the second cross section, such that the housing includes at least one geometric asymmetry; at least one LED arranged in the housing; and a connector at and end of the housing configured for connection to a light fixture.

15 Claims, 3 Drawing Sheets

(51) Int. Cl.

| | |
|---|---|
| ***F21V 23/02*** | (2006.01) |
| *F21V 3/02* | (2006.01) |
| *F21V 19/00* | (2006.01) |
| *F21Y 101/02* | (2006.01) |
| *F21Y 103/00* | (2006.01) |
| *F21V 29/507* | (2015.01) |
| *F21V 29/70* | (2015.01) |

(56) References Cited

U.S. PATENT DOCUMENTS

| | | | |
|---|---|---|---|
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenburg |
| 2,909,097 | A | 10/1959 | Alden et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |

(56) References Cited

U.S. PATENT DOCUMENTS 5,126,634 A 6/1992 Johnson
5,128,595 A 7/1992 Hara
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,278,542 A 1/1994 Smith et al.
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,904,415 A 5/1999 Robertson et al.
5,907,742 A 5/1999 Johnson et al.
5,909,378 A 6/1999 De Milleville
5,912,653 A 6/1999 Fitch
5,917,287 A 6/1999 Haederle et al.
5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota

(56) References Cited

U.S. PATENT DOCUMENTS 5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
D477,093 S 7/2003 Moriyama et al.
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,609,813 B1 8/2003 Showers et al.

(56) References Cited

U.S. PATENT DOCUMENTS 6,612,712 B2 9/2003 Nepil
6,612,717 B2 9/2003 Yen
6,612,729 B1 9/2003 Hoffman
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,525 B2 5/2004 Chin
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,883,929 B2 4/2005 Dowling
6,883,934 B2 4/2005 Kawakami et al.
6,888,322 B2 5/2005 Dowling et al.
6,897,624 B2 5/2005 Lys et al.
D506,274 S 6/2005 Moriyama et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,029,145 B2 4/2006 Frederick
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.

(56) References Cited

U.S. PATENT DOCUMENTS

| | | | |
|---|---|---|---|
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| D586,484 | S | 2/2009 | Liu et al. |
| D586,928 | S | 2/2009 | Liu et al. |
| 7,490,957 | B2 | 2/2009 | Leong et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,594,738 | B1 | 9/2009 | Lin et al. |

(56) References Cited

U.S. PATENT DOCUMENTS

| | | | |
|---|---|---|---|
| D601,726 | S | 10/2009 | Mollaert et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| D610,724 | S | 2/2010 | Chiang et al. |
| 7,661,839 | B2 | 2/2010 | Tsai |
| D612,528 | S | 3/2010 | McGrath et al. |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| D634,452 | S | 3/2011 | de Visser |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Trumble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,159,152 | B1 | 4/2012 | Salessi |
| D660,472 | S | 5/2012 | Aguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,398,275 | B2 | 3/2013 | Wang et al. |
| 8,403,692 | B2 | 3/2013 | Cao et al. |
| 8,405,314 | B2 | 3/2013 | Jensen |
| 8,434,914 | B2 | 5/2013 | Li et al. |
| 8,454,193 | B2 | 6/2013 | Simon et al. |
| 2001/0033488 | A1 | 10/2001 | Chliwnyj et al. |
| 2001/0045803 | A1 | 11/2001 | Cencur |
| 2002/0011801 | A1 | 1/2002 | Chang |
| 2002/0015297 | A1 | 2/2002 | Hayashi et al. |
| 2002/0038157 | A1 | 3/2002 | Dowling et al. |
| 2002/0044066 | A1 | 4/2002 | Dowling et al. |
| 2002/0047516 | A1 | 4/2002 | Iwasa et al. |
| 2002/0047569 | A1 | 4/2002 | Dowling et al. |
| 2002/0047624 | A1 | 4/2002 | Stam et al. |
| 2002/0047628 | A1 | 4/2002 | Morgan et al. |
| 2002/0048169 | A1 | 4/2002 | Dowling et al. |
| 2002/0057061 | A1 | 5/2002 | Mueller et al. |
| 2002/0060526 | A1 | 5/2002 | Timmermans et al. |
| 2002/0070688 | A1 | 6/2002 | Dowling et al. |
| 2002/0074559 | A1 | 6/2002 | Dowling et al. |
| 2002/0074958 | A1 | 6/2002 | Crenshaw |
| 2002/0078221 | A1 | 6/2002 | Blackwell et al. |
| 2002/0101197 | A1 | 8/2002 | Lys et al. |
| 2002/0113555 | A1 | 8/2002 | Lys et al. |
| 2002/0130627 | A1 | 9/2002 | Morgan et al. |
| 2002/0145394 | A1 | 10/2002 | Morgan et al. |
| 2002/0145869 | A1 | 10/2002 | Dowling |
| 2002/0152045 | A1 | 10/2002 | Dowling et al. |
| 2002/0152298 | A1 | 10/2002 | Kikta et al. |
| 2002/0153851 | A1 | 10/2002 | Morgan et al. |
| 2002/0158583 | A1 | 10/2002 | Lys et al. |
| 2002/0163316 | A1 | 11/2002 | Lys et al. |
| 2002/0171365 | A1 | 11/2002 | Morgan et al. |
| 2002/0171377 | A1 | 11/2002 | Mueller et al. |
| 2002/0171378 | A1 | 11/2002 | Morgan et al. |
| 2002/0176259 | A1 | 11/2002 | Ducharme |
| 2002/0179816 | A1 | 12/2002 | Haines et al. |
| 2002/0195975 | A1 | 12/2002 | Schanberger et al. |
| 2003/0011538 | A1 | 1/2003 | Lys et al. |
| 2003/0021117 | A1 | 1/2003 | Chan |
| 2003/0028260 | A1 | 2/2003 | Blackwell |
| 2003/0031015 | A1 | 2/2003 | Ishibashi |
| 2003/0048641 | A1 | 3/2003 | Alexanderson et al. |
| 2003/0052599 | A1 | 3/2003 | Sun |
| 2003/0057884 | A1 | 3/2003 | Dowling et al. |
| 2003/0057886 | A1 | 3/2003 | Lys et al. |
| 2003/0057887 | A1 | 3/2003 | Dowling et al. |
| 2003/0057890 | A1 | 3/2003 | Lys et al. |
| 2003/0076281 | A1 | 4/2003 | Morgan et al. |
| 2003/0085710 | A1 | 5/2003 | Bourgault et al. |
| 2003/0095404 | A1 | 5/2003 | Becks et al. |
| 2003/0100837 | A1 | 5/2003 | Lys et al. |
| 2003/0102810 | A1 | 6/2003 | Cross et al. |
| 2003/0133292 | A1 | 7/2003 | Mueller et al. |
| 2003/0137258 | A1 | 7/2003 | Piepgras et al. |
| 2003/0185005 | A1 | 10/2003 | Sommers et al. |
| 2003/0185014 | A1 | 10/2003 | Gloisten |
| 2003/0189412 | A1 | 10/2003 | Cunningham |
| 2003/0218879 | A1 | 11/2003 | Tieszen |
| 2003/0222587 | A1 | 12/2003 | Dowling, Jr. et al. |
| 2003/0234342 | A1 | 12/2003 | Gaines et al. |
| 2004/0003545 | A1 | 1/2004 | Gillespie |
| 2004/0007980 | A1 | 1/2004 | Shibata |
| 2004/0012959 | A1 | 1/2004 | Robertson et al. |
| 2004/0036006 | A1 | 2/2004 | Dowling |
| 2004/0037088 | A1 | 2/2004 | English et al. |
| 2004/0052076 | A1 | 3/2004 | Mueller et al. |
| 2004/0062041 | A1 | 4/2004 | Cross et al. |
| 2004/0075572 | A1 | 4/2004 | Buschmann et al. |
| 2004/0080960 | A1 | 4/2004 | Wu |
| 2004/0090191 | A1 | 5/2004 | Mueller et al. |
| 2004/0090787 | A1 | 5/2004 | Dowling et al. |
| 2004/0105261 | A1 | 6/2004 | Ducharme et al. |
| 2004/0105264 | A1 | 6/2004 | Spero |
| 2004/0113568 | A1 | 6/2004 | Dowling et al. |
| 2004/0114371 | A1 | 6/2004 | Lea et al. |
| 2004/0116039 | A1 | 6/2004 | Mueller et al. |

(56) References Cited

U.S. PATENT DOCUMENTS

| | | | |
|---|---|---|---|
| 2004/0124782 | A1 | 7/2004 | Yu |
| 2004/0130908 | A1 | 7/2004 | McClurg et al. |
| 2004/0130909 | A1 | 7/2004 | Mueller et al. |
| 2004/0141321 | A1 | 7/2004 | Dowling et al. |
| 2004/0145886 | A1 | 7/2004 | Fatemi et al. |
| 2004/0155609 | A1 | 8/2004 | Lys et al. |
| 2004/0160199 | A1 | 8/2004 | Morgan et al. |
| 2004/0178751 | A1 | 9/2004 | Mueller et al. |
| 2004/0189262 | A1 | 9/2004 | McGrath |
| 2004/0212320 | A1 | 10/2004 | Dowling et al. |
| 2004/0212321 | A1 | 10/2004 | Lys et al. |
| 2004/0212993 | A1 | 10/2004 | Morgan et al. |
| 2004/0223328 | A1 | 11/2004 | Lee et al. |
| 2004/0240890 | A1 | 12/2004 | Lys et al. |
| 2004/0251854 | A1 | 12/2004 | Matsuda et al. |
| 2004/0257007 | A1 | 12/2004 | Lys et al. |
| 2005/0013133 | A1 | 1/2005 | Yeh |
| 2005/0024877 | A1 | 2/2005 | Frederick |
| 2005/0030744 | A1 | 2/2005 | Ducharme et al. |
| 2005/0035728 | A1 | 2/2005 | Schanberger et al. |
| 2005/0036300 | A1 | 2/2005 | Dowling et al. |
| 2005/0040774 | A1 | 2/2005 | Mueller et al. |
| 2005/0041161 | A1 | 2/2005 | Dowling et al. |
| 2005/0041424 | A1 | 2/2005 | Ducharme |
| 2005/0043907 | A1 | 2/2005 | Eckel et al. |
| 2005/0044617 | A1 | 3/2005 | Mueller et al. |
| 2005/0047132 | A1 | 3/2005 | Dowling et al. |
| 2005/0047134 | A1 | 3/2005 | Mueller et al. |
| 2005/0062440 | A1 | 3/2005 | Lys et al. |
| 2005/0063194 | A1 | 3/2005 | Lys et al. |
| 2005/0078477 | A1 | 4/2005 | Lo |
| 2005/0093488 | A1 | 5/2005 | Hung et al. |
| 2005/0099824 | A1 | 5/2005 | Dowling et al. |
| 2005/0107694 | A1 | 5/2005 | Jansen et al. |
| 2005/0110384 | A1 | 5/2005 | Peterson |
| 2005/0116667 | A1 | 6/2005 | Mueller et al. |
| 2005/0128751 | A1 | 6/2005 | Roberge et al. |
| 2005/0141225 | A1 | 6/2005 | Striebel |
| 2005/0151489 | A1 | 7/2005 | Lys et al. |
| 2005/0151663 | A1 | 7/2005 | Tanguay |
| 2005/0154494 | A1 | 7/2005 | Ahmed |
| 2005/0162093 | A1 | 7/2005 | Timmermans et al. |
| 2005/0162100 | A1 | 7/2005 | Romano et al. |
| 2005/0162101 | A1 | 7/2005 | Leong et al. |
| 2005/0174473 | A1 | 8/2005 | Morgan et al. |
| 2005/0174780 | A1 | 8/2005 | Park |
| 2005/0184667 | A1 | 8/2005 | Sturman et al. |
| 2005/0201112 | A1 | 9/2005 | Machi et al. |
| 2005/0206529 | A1 | 9/2005 | St.-Germain |
| 2005/0213320 | A1 | 9/2005 | Kazuhiro et al. |
| 2005/0213352 | A1 | 9/2005 | Lys |
| 2005/0213353 | A1 | 9/2005 | Lys |
| 2005/0218838 | A1 | 10/2005 | Lys |
| 2005/0218870 | A1 | 10/2005 | Lys |
| 2005/0219860 | A1 | 10/2005 | Schexnaider |
| 2005/0219872 | A1 | 10/2005 | Lys |
| 2005/0225979 | A1 | 10/2005 | Robertson et al. |
| 2005/0231133 | A1 | 10/2005 | Lys |
| 2005/0236029 | A1 | 10/2005 | Dowling |
| 2005/0236998 | A1 | 10/2005 | Mueller et al. |
| 2005/0242742 | A1 | 11/2005 | Cheang et al. |
| 2005/0243577 | A1 | 11/2005 | Moon |
| 2005/0248299 | A1 | 11/2005 | Chemel et al. |
| 2005/0253533 | A1 | 11/2005 | Lys et al. |
| 2005/0259424 | A1 | 11/2005 | Zampini et al. |
| 2005/0264474 | A1 | 12/2005 | Rast |
| 2005/0265019 | A1 | 12/2005 | Sommers et al. |
| 2005/0275626 | A1 | 12/2005 | Mueller et al. |
| 2005/0276051 | A1 | 12/2005 | Caudle et al. |
| 2005/0276053 | A1 | 12/2005 | Nortrup et al. |
| 2005/0276064 | A1 | 12/2005 | Wu et al. |
| 2005/0281030 | A1 | 12/2005 | Leong et al. |
| 2005/0285547 | A1 | 12/2005 | Piepgras et al. |
| 2006/0002110 | A1 | 1/2006 | Dowling et al. |
| 2006/0012987 | A9 | 1/2006 | Ducharme et al. |
| 2006/0012997 | A1 | 1/2006 | Catalano et al. |
| 2006/0016960 | A1 | 1/2006 | Morgan et al. |
| 2006/0022214 | A1 | 2/2006 | Morgan et al. |
| 2006/0028155 | A1 | 2/2006 | Young |
| 2006/0028837 | A1 | 2/2006 | Mrakovich |
| 2006/0034078 | A1 | 2/2006 | Kovacik et al. |
| 2006/0050509 | A9 | 3/2006 | Dowling et al. |
| 2006/0050514 | A1 | 3/2006 | Opolka |
| 2006/0056855 | A1 | 3/2006 | Nakagawa et al. |
| 2006/0066447 | A1 | 3/2006 | Davenport et al. |
| 2006/0076908 | A1 | 4/2006 | Morgan et al. |
| 2006/0081863 | A1 | 4/2006 | Kim et al. |
| 2006/0092640 | A1 | 5/2006 | Li |
| 2006/0098077 | A1 | 5/2006 | Dowling |
| 2006/0104058 | A1 | 5/2006 | Chemel et al. |
| 2006/0109648 | A1 | 5/2006 | Trenchard et al. |
| 2006/0109649 | A1 | 5/2006 | Ducharme et al. |
| 2006/0109661 | A1 | 5/2006 | Coushaine et al. |
| 2006/0126325 | A1 | 6/2006 | Lefebvre et al. |
| 2006/0126338 | A1 | 6/2006 | Mighetto |
| 2006/0132061 | A1 | 6/2006 | McCormick et al. |
| 2006/0132323 | A1 | 6/2006 | Grady |
| 2006/0146531 | A1 | 7/2006 | Reo et al. |
| 2006/0152172 | A9 | 7/2006 | Mueller et al. |
| 2006/0158881 | A1 | 7/2006 | Dowling |
| 2006/0170376 | A1 | 8/2006 | Piepgras et al. |
| 2006/0192502 | A1 | 8/2006 | Brown et al. |
| 2006/0193131 | A1 | 8/2006 | McGrath et al. |
| 2006/0197661 | A1 | 9/2006 | Tracy et al. |
| 2006/0198128 | A1 | 9/2006 | Piepgras et al. |
| 2006/0208667 | A1 | 9/2006 | Lys et al. |
| 2006/0215422 | A1 | 9/2006 | Laizure et al. |
| 2006/0220595 | A1 | 10/2006 | Lu |
| 2006/0221606 | A1 | 10/2006 | Dowling |
| 2006/0221619 | A1 | 10/2006 | Nishigaki |
| 2006/0227558 | A1 | 10/2006 | Osawa et al. |
| 2006/0232974 | A1 | 10/2006 | Lee et al. |
| 2006/0238884 | A1 | 10/2006 | Jang et al. |
| 2006/0262516 | A9 | 11/2006 | Dowling et al. |
| 2006/0262521 | A1 | 11/2006 | Piepgras et al. |
| 2006/0262544 | A1 | 11/2006 | Piepgras et al. |
| 2006/0262545 | A1 | 11/2006 | Piepgras et al. |
| 2006/0265921 | A1 | 11/2006 | Korall et al. |
| 2006/0273741 | A1 | 12/2006 | Stalker |
| 2006/0274529 | A1 | 12/2006 | Cao |
| 2006/0285325 | A1 | 12/2006 | Ducharme et al. |
| 2007/0035255 | A1 | 2/2007 | Shuster et al. |
| 2007/0035538 | A1 | 2/2007 | Garcia et al. |
| 2007/0035965 | A1 | 2/2007 | Holst |
| 2007/0040516 | A1 | 2/2007 | Chen |
| 2007/0041220 | A1 | 2/2007 | Lynch |
| 2007/0047227 | A1 | 3/2007 | Ducharme |
| 2007/0053182 | A1 | 3/2007 | Robertson |
| 2007/0053208 | A1 | 3/2007 | Justel et al. |
| 2007/0064419 | A1 | 3/2007 | Gandhi |
| 2007/0064425 | A1 | 3/2007 | Frecska et al. |
| 2007/0070621 | A1 | 3/2007 | Rivas et al. |
| 2007/0070631 | A1 | 3/2007 | Huang et al. |
| 2007/0081423 | A1 | 4/2007 | Chien |
| 2007/0086754 | A1 | 4/2007 | Lys et al. |
| 2007/0086912 | A1 | 4/2007 | Dowling et al. |
| 2007/0097678 | A1 | 5/2007 | Yang |
| 2007/0109763 | A1 | 5/2007 | Wolf et al. |
| 2007/0115658 | A1 | 5/2007 | Mueller et al. |
| 2007/0115665 | A1 | 5/2007 | Mueller et al. |
| 2007/0120463 | A1 | 5/2007 | Hayashi et al. |
| 2007/0120594 | A1 | 5/2007 | Balakrishnan et al. |
| 2007/0127234 | A1 | 6/2007 | Jervey |
| 2007/0133202 | A1 | 6/2007 | Huang et al. |
| 2007/0139938 | A1 | 6/2007 | Petroski et al. |
| 2007/0145915 | A1 | 6/2007 | Roberge et al. |
| 2007/0146126 | A1 | 6/2007 | Wang |
| 2007/0147046 | A1 | 6/2007 | Arik et al. |
| 2007/0152797 | A1 | 7/2007 | Chemel et al. |
| 2007/0152808 | A1 | 7/2007 | LaCasse |
| 2007/0153514 | A1 | 7/2007 | Dowling et al. |
| 2007/0159828 | A1 | 7/2007 | Wang |
| 2007/0165402 | A1 | 7/2007 | Weaver et al. |
| 2007/0165405 | A1 | 7/2007 | Chen |

(56) References Cited

U.S. PATENT DOCUMENTS

2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046222 A1 2/2010 Yang
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0181178 A1 7/2010 Chang et al.
2010/0207547 A1 8/2010 Kuroki et al.
2010/0220469 A1 9/2010 Ivey et al.
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0320922 A1 12/2010 Palazzol et al.
2011/0006658 A1 1/2011 Chan et al.
2011/0090682 A1 4/2011 Zheng et al.
2011/0109454 A1 5/2011 McSheffrey, Sr. et al.

(56) References Cited

U.S. PATENT DOCUMENTS

| | | | | |
|---|---|---|---|---|
| 2011/0149564 | A1* | 6/2011 | Hsia et al. | 362/221 |
| 2011/0156584 | A1 | 6/2011 | Kim | |
| 2011/0176298 | A1 | 7/2011 | Meurer et al. | |
| 2011/0199723 | A1 | 8/2011 | Sato | |
| 2011/0199769 | A1 | 8/2011 | Bretschneider et al. | |
| 2011/0291588 | A1 | 12/2011 | Tagare | |
| 2012/0014086 | A1 | 1/2012 | Jonsson | |
| 2012/0043892 | A1 | 2/2012 | Visser et al. | |
| 2012/0063140 | A1 | 3/2012 | Kong | |
| 2012/0080994 | A1 | 4/2012 | Chin et al. | |
| 2012/0081891 | A1 | 4/2012 | Tung et al. | |
| 2012/0098439 | A1 | 4/2012 | Recker et al. | |
| 2012/0106144 | A1 | 5/2012 | Chang | |
| 2012/0113628 | A1 | 5/2012 | Burrow et al. | |
| 2012/0127726 | A1 | 5/2012 | Yen | |
| 2012/0146503 | A1 | 6/2012 | Negley et al. | |
| 2012/0147597 | A1 | 6/2012 | Farmer | |
| 2012/0153865 | A1 | 6/2012 | Rolfes et al. | |
| 2012/0155073 | A1 | 6/2012 | McCanless et al. | |
| 2012/0161666 | A1 | 6/2012 | Antony et al. | |
| 2012/0194086 | A1 | 8/2012 | Liu et al. | |
| 2012/0195032 | A1 | 8/2012 | Shew | |
| 2012/0212951 | A1 | 8/2012 | Lai et al. | |
| 2012/0212953 | A1 | 8/2012 | Bloom et al. | |
| 2012/0230044 | A1 | 9/2012 | Zhang et al. | |
| 2012/0236533 | A1 | 9/2012 | Nakamura et al. | |
| 2012/0236554 | A1 | 9/2012 | Rust | |
| 2012/0243216 | A1 | 9/2012 | Lai et al. | |
| 2012/0243217 | A1 | 9/2012 | Szprengiel et al. | |
| 2012/0274214 | A1 | 11/2012 | Radermacher et al. | |
| 2012/0275154 | A1 | 11/2012 | Hood et al. | |
| 2012/0293991 | A1 | 11/2012 | Lin | |
| 2012/0293996 | A1 | 11/2012 | Thomas et al. | |
| 2012/0300409 | A1* | 11/2012 | Lee | 361/721 |
| 2012/0300445 | A1 | 11/2012 | Chu et al. | |
| 2012/0300468 | A1 | 11/2012 | Chang et al. | |
| 2012/0307524 | A1 | 12/2012 | Schapira et al. | |
| 2012/0320598 | A1 | 12/2012 | Son | |
| 2013/0039051 | A1 | 2/2013 | Wu | |
| 2013/0044471 | A1 | 2/2013 | Chen | |
| 2013/0044476 | A1 | 2/2013 | Bretschneider et al. | |
| 2013/0050997 | A1 | 2/2013 | Bretschneider et al. | |
| 2013/0050998 | A1 | 2/2013 | Chu et al. | |
| 2013/0057146 | A1 | 3/2013 | Chao | |
| 2013/0058079 | A1 | 3/2013 | Dellian et al. | |
| 2013/0063944 | A1 | 3/2013 | Lodhie et al. | |
| 2013/0077297 | A1 | 3/2013 | Wu et al. | |
| 2013/0094200 | A1 | 4/2013 | Dellian et al. | |
| 2013/0148349 | A1 | 6/2013 | Pasqualini et al. | |

FOREIGN PATENT DOCUMENTS

| | | | |
|---|---|---|---|
| CN | 2869556 | Y | 2/2007 |
| CN | 101016976 | A | 8/2007 |
| CN | 101075605 | A | 11/2007 |
| CN | 201129681 | Y | 10/2008 |
| CN | 201184574 | Y | 1/2009 |
| CN | 101737664 | A1 | 6/2010 |
| DE | 19651140 | A1 | 6/1997 |
| DE | 19624087 | A1 | 12/1997 |
| DE | 29819966 | U1 | 3/1999 |
| DE | 29817609 | U1 | 1/2000 |
| DE | 20018865 | U1 | 2/2001 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0714556 | | 1/1991 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | | 1/1995 |
| EP | 0432848 | B1 | 4/1995 |
| EP | 0659531 | A1 | 6/1995 |
| EP | 0403001 | B1 | 8/1995 |
| EP | 0525876 | | 5/1996 |
| EP | 0889283 | A1 | 7/1999 |
| EP | 0458408 | B1 | 9/1999 |
| EP | 0578302 | B1 | 9/1999 |
| EP | 0723701 | B1 | 1/2000 |
| EP | 1142452 | B1 | 3/2001 |
| EP | 0787419 | B1 | 5/2001 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | A1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | B1 | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| GB | 2495647 | A | 4/2013 |

(56) References Cited

FOREIGN PATENT DOCUMENTS

| | | | |
|---|---|---|---|
| JP | 06-054289 | | 2/1994 |
| JP | H6-54103 | U | 7/1994 |
| JP | 07-249467 | | 9/1995 |
| JP | 7264036 | | 10/1995 |
| JP | 08-162677 | A | 6/1996 |
| JP | 11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2010-192229 | A1 | 9/2010 |
| JP | 2010-205553 | A | 9/2010 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | 99-06759 | A1 | 2/1999 |
| WO | 99-10867 | A1 | 3/1999 |
| WO | 99-31560 | A2 | 6/1999 |
| WO | 99/45312 | A1 | 9/1999 |
| WO | 99/57945 | A1 | 11/1999 |
| WO | 00/01067 | A2 | 1/2000 |
| WO | WO0225842 | A2 | 3/2002 |
| WO | 02-61330 | | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |
| WO | WO03026358 | A1 | 3/2003 |
| WO | WO03055273 | A2 | 7/2003 |
| WO | WO03067934 | A2 | 8/2003 |
| WO | WO03090890 | A1 | 11/2003 |
| WO | WO03096761 | A1 | 11/2003 |
| WO | WO2004021747 | A2 | 3/2004 |
| WO | WO2004023850 | A2 | 3/2004 |
| WO | WO2004032572 | A2 | 4/2004 |
| WO | WO2004057924 | | 7/2004 |
| WO | WO2004100624 | A2 | 11/2004 |
| WO | WO2005031860 | A2 | 4/2005 |
| WO | WO2005052751 | A2 | 6/2005 |
| WO | WO2005060309 | A2 | 6/2005 |
| WO | WO2005084339 | A2 | 9/2005 |
| WO | WO2005089293 | A2 | 9/2005 |
| WO | WO2005089309 | A2 | 9/2005 |
| WO | WO2005103555 | A1 | 11/2005 |
| WO | WO2005116519 | A1 | 12/2005 |
| WO | WO2006023149 | A2 | 3/2006 |
| WO | WO2006044328 | A1 | 4/2006 |
| WO | WO2006046207 | A1 | 5/2006 |
| WO | WO2006056120 | A1 | 6/2006 |
| WO | WO2006093889 | A2 | 9/2006 |
| WO | WO2006127666 | A2 | 11/2006 |
| WO | WO2006127785 | A2 | 11/2006 |
| WO | WO2006133272 | A2 | 12/2006 |
| WO | WO2006137686 | A1 | 12/2006 |
| WO | WO2007004679 | A1 | 1/2007 |
| WO | WO2007081674 | A1 | 7/2007 |
| WO | WO2007090292 | A1 | 8/2007 |
| WO | WO2007094810 | A2 | 8/2007 |
| WO | WO2008018002 | A2 | 2/2008 |
| WO | WO2008027093 | A2 | 3/2008 |
| WO | WO2008061991 | A1 | 5/2008 |
| WO | WO2008110978 | A1 | 9/2008 |
| WO | WO2008137460 | A2 | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A3 | 4/2010 |
| WO | WO2010047898 | A3 | 4/2010 |
| WO | WO2010047973 | A3 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | A2 | 1/2011 |
| WO | WO2011005579 | A2 | 1/2011 |
| WO | 2011/021719 | A1 | 2/2011 |
| WO | WO2011072308 | A1 | 6/2011 |
| WO | WO2011113709 | A2 | 9/2011 |
| WO | WO2011117059 | A1 | 9/2011 |
| WO | WO2012001584 | A1 | 1/2012 |
| WO | WO2012004708 | A2 | 1/2012 |
| WO | WO2012007899 | A1 | 1/2012 |
| WO | 2012/019535 | A1 | 2/2012 |
| WO | WO2012025626 | A1 | 3/2012 |
| WO | WO2012063174 | A1 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | 2013/097823 | A1 | 7/2013 |
| WO | 2013/098700 | A1 | 7/2013 |

OTHER PUBLICATIONS

PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.

Saha et al, "Location Determination of a Mobile Device using IEEE 802.11 Access Point Signals", May 5, 2002 in 20 pages.

Sensor Switch, nLight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http://www.encelium.com/products/strategies.html>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_1000000000000056772>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

(56) References Cited

OTHER PUBLICATIONS

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
International Search Report and Written Opinion dated Feb. 15, 2013 from the corresponding International Application No. PCT/US2012/052244 filed on Aug. 24, 2012.
International Search Report and Written Opinion dated Aug. 30, 2011 for the corresponding International Application No. PCT/US2011/029994 filed Mar. 25, 2011.
Notification of Transmittal, the International Search Report and the Written Opinion of the International Searching Authority dated May 7, 2012, from the corresponding International Application No. PCT/US2011/064151.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
International Report on Patentability dated May 24, 2010 from the corresponding International Application No. PCT/US2009/060087 filed Oct. 9, 2009.
Extended European Search Report for co-pending European Application No. 10 73 2124 mailed on Dec. 13, 2012 in 8 pages.
Extended European Search Report for co-pending European Application No. 09822425.6 mailed on Aug. 30, 2012 in 9 pages.
Extended European Search Report for co-pending European Application No. 10797596.3 mailed on Jan. 17, 2013 in 11pages.
Extended European Search Report for co-pending European Application No. 10736237.8 mailed on Oct. 19, 2012 in 5 pages.
Extended European Search Report for co-pending European Application No. 10738925.6 mailed on Oct. 1, 2012 in 7 pages.
Examination and Search Report mailed on Jul. 2, 2012 in cooresponding United Kingdom Application No. 1018896.9 in 4 pages.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
Notification of Transmittal, the International Search Report and the Written Opinion of the International Searching Authority dated May 7, 2012 from the corresponding International Application No. PCT/US2011/058312.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009.
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.
International Search Report and Written Opinion dated Feb. 9, 2012 from the corresponding International Application No. PCT/US2011/043524 filed on Jul. 11, 2011.
Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.
Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.
D.N.A.-III, [online], [retrieved Mar. 10, 2009] Retrieved from the PLC Lighting Web Page using Internet <URL: http://www.plclighting.com/product_info.php?cPath=1&products_id=92>.

(56) References Cited

OTHER PUBLICATIONS

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.
Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/1abs/ballast.pdf.>.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.
Hightower et al, "A Survey and Taxonomy of Location Systems for Ubiquitous Computing", University of Washington, Computer Science and Engineering, Technical Report UW-CSE Jan. 8, 2003, IEEE, Aug. 24, 2001 in 29 pages.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbn11871.html>.
LCD Optics 101 Tutorial [online]. 3M Corporation, [retrieved on Jan. 6, 2010]. Retrieved from the internet: <URL: http://solutions.3m.com/wps/porta1/3M/en_US/Vikuiti1/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
LEDtronic, LEDtronic Catalog, 1996, p. 10, LEDtronics, Torrance, California.
Phason Electronic Control Systems, Light Level Controller (LLC) case study. Nov. 30, 2004. 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

* cited by examiner

POWER SUPPLY ASSEMBLY FOR LED-BASED LIGHT TUBE

CROSS REFERENCE TO RELATED APPLICATION

This application claims priority benefit to U.S. Provisional Patent Application No. 61/668,720 filed Jul. 6, 2012, the contents of which is hereby incorporated by reference in its entirety.

TECHNICAL FIELD

The embodiments disclosed herein relate in general to a light emitting diode (LED)-based light for replacing a conventional light in a standard fluorescent light fixture, and in particular to an LED-based light including a power supply assembly.

BACKGROUND

Fluorescent lights may be used in a variety of locations, such as schools and commercial buildings and residential dwellings. Although fluorescent lights may have certain advantages over, for example, incandescent lights, they may also pose certain disadvantages including, inter alia, disposal problems due to the presence of potentially toxic materials within the light.

LED-based lights designed as one-for-one replacements for fluorescent tube lights have appeared in recent years. These LED-based lights can define a housing that includes circuitry configured to condition power received from a power supply to a power usable to operate the LEDs of the LED-based light.

SUMMARY

Disclosed herein are embodiments of LED-based lights. In one aspect, an LED-based light for replacing a fluorescent light in a light fixture comprises: an elongate housing, the housing having a first longitudinal portion with a first cross section and a second longitudinal portion adjoining the first longitudinal portion with a second cross section, wherein a shape of the first cross section is different from a shape of the second cross section, such that the housing includes at least one geometric asymmetry; at least one LED arranged in the housing; and a connector at and end of the housing configured for connection to a light fixture.

In another aspect, an LED-based light for replacing a fluorescent light in a light fixture comprises: an elongate base defining a first surface and an opposing second surface; an LED circuit board supported on the first surface of the base, the LED circuit board including at least one LED; a light transmitting lens attached to the base to enclose the LED-circuit board, the lens extending a substantial length of the base; a power supply circuit board located adjacent the second surface of the base, the power supply circuit board configured to supply power to the at least one LED; and a cover attached to the base to enclose the power supply circuit board, the cover extending only a partial length of the base.

In yet another aspect, an LED-based light for replacing a fluorescent light in a light fixture comprises: an elongate base; an LED circuit board supported on the base, the LED circuit board including at least one LED; a light transmitting lens attached to the base to enclose the LED-circuit board; and a power supply assembly selectively removably attached to the base, the power supply assembly including power supply circuitry configured to supply power to the at least one LED.

These and other aspects will be described in additional detail below.

BRIEF DESCRIPTION OF THE DRAWINGS

The various features, advantages and other uses of the present apparatus will become more apparent by referring to the following detailed description and drawings in which.

DETAILED DESCRIPTION

The embodiments of an LED-based light described herein include a unique housing configuration and a novel power supply assembly configured to condition a power received from a power supply to a power usable to operate the LEDs of the LED-based light.

Figure 1:
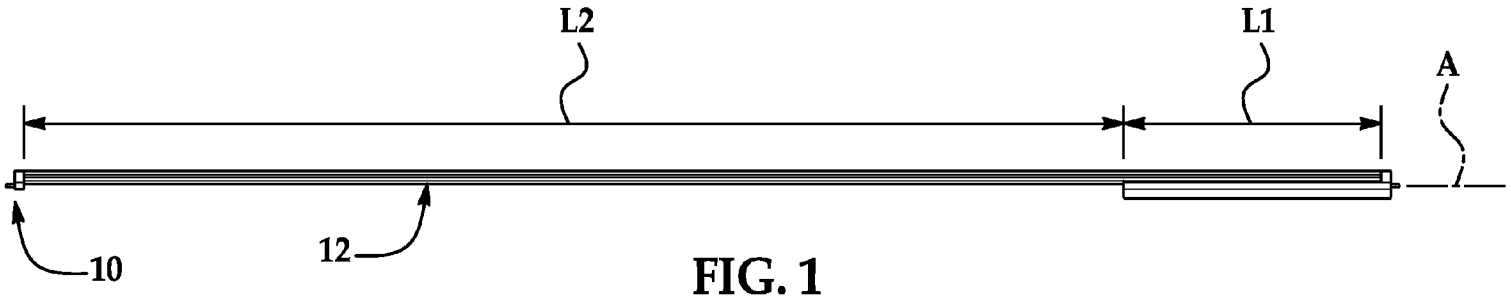
FIG. 1 is a side plan view of an exemplary LED-based light.

FIG. 1 illustrates an exemplary LED-based light 10 for replacing a conventional light in a light fixture. The light fixture can be designed to accept conventional fluorescent lights, such as T5, T8 or T12 fluorescent tube lights, or can be designed to accept non-standard fluorescent lights, such as lights installed by an electrician. The fixture can connect to a power source, and may include a ballast electrically connected between the power source and LED-based light 10.

A perimeter boundary of the LED-based light 10 defines a housing 12 for housing components of the LED-based light 10. The illustrated housing 12 is an elongated housing extending along a longitudinal axis A of the LED-based light 10. Although the housing 12 is illustrated as an elongated linear housing extending along a linear longitudinal axis A, housings having alternative longitudinal shapes, e.g., U-shaped or circular shaped housings, can alternatively be used. The LED-based light 10 can have any suitable length. For example, the LED-based light 10 may be approximately 48" long, and the housing 12 can have a 0.625", 1.0" or 1.5" diameter for engagement with a standard fluorescent light fixture.

The housing 12 can have one or more cross sectional shapes. For example, cylindrical, square, triangular, polygonal, or other cross sectional shapes can be used for the housing 12. The housing 12 can have a uniform lengthwise cross sectional shape, or as shown in FIG. 1, the housing 12 can have a cross sectional shape that varies at different points along the longitudinal axis A.

The housing 12 of the LED-based light 10 generally extends a length along the longitudinal axis A, and can include multiple partial lengths, for example, a first partial length L1 and a second partial length L2. In the illustrated the housing 12, each of the partial lengths L1 and L2 includes at least one portion with a cross sectional shape different from the cross sectional shape of a portion of an adjoining partial length. For example, the housing 12 of the LED-based light 10 shown in FIG. 1 generally extends a length along the longitudinal axis A, with the first partial length L1 of the housing 12 having a first cross sectional shape, and with the second partial length L2 of the housing 12 having a second cross sectional shape different from the first cross sectional shape. In the illustrated exemplary implementation of the LED-based light 10, the housing 12 has two partial lengths L1 and L2, with each of the illustrated partial lengths L1 and L2 of the housing 12 being continuous along the longitudinal axis A and having substantially constant respective cross sectional shapes. In addition, the illustrated partial lengths L1 and L2 adjoin each other to substantially extend an entire length of the housing 12. However, the housing 12 could have multiple other partial lengths, each having a portion with a differing cross sectional shape as compared to one or more respective adjoining partial lengths. In addition, the partial lengths need not be discrete, with constant cross sectional shapes. For example, the cross sectional shapes of one or more partial lengths of the housing 12 could be continuously variable.

The LED-based light 10, having a housing 12 with a cross sectional shape that varies at different points along the longitudinal axis A, can define one or more asymmetries. For example, the housing 12 shown in FIG. 1 is asymmetric about an imaginary plane normal to the longitudinal axis A of the housing 12 and positioned approximate a midpoint of the length of the housing 12. Depending upon its configuration, the housing 12 having a cross sectional shape that varies at different points along its longitudinal axis A could alternatively be symmetric about the above described imaginary plane but include one or more other geometric asymmetries. However, the housing 12 could also generally be geometrically symmetrical.

The housing 12 of the LED-based light 10 can at least partially be defined by an exterior part of a light transmitting portion. For example, with reference to FIG. 2, the housing 12 of the LED-based light 10 is at least partially defined by the exterior of a high dielectric light transmitting lens 14. The lens 14 can be made from polycarbonate, acrylic, glass or other light transmitting material (i.e., the lens 14 can be transparent or translucent). The term "lens" as used herein means a light transmitting structure, and not necessarily a structure for concentrating or diverging light.

The LED-based light 10 can include features for uniformly distributing light to an environment to be illuminated in order to replicate the uniform light distribution of a conventional fluorescent light. For example, the lens 14 can be manufactured to include light diffracting structures, such as ridges, dots, bumps, dimples or other uneven surfaces formed on an interior or exterior of the lens 14. The light diffracting structures can be formed integrally with the lens 14, for example, by molding or extruding, or the structures can be formed in a separate manufacturing step such as surface roughening. In addition to or as an alternative to light diffracting structures, a light diffracting film can be applied to the exterior of the lens 14 or placed in the housing 12, or, the material from which the lens 14 is formed can include light refracting particles. For example, the lens 14 can be made from a composite, such as polycarbonate, with particles of a light refracting material interspersed in the polycarbonate. In other embodiments, the LED-based light 10 may not include any light diffracting structures or film.

The housing 12 of the LED-based light 10 is at least partially defined by the exterior of the lens 14. The remainder of the housing 12 can generally be defined by the exterior of a lower portion 16 positioned opposite the lens 14. The lower portion 16 could be integral with the lens 14. For example, the housing 12 could include a light transmitting tube at least partially defined by the lens 14 and at least partially defined by a lower portion 16. The housing 12 may be formed by attaching multiple individual parts, not all of which need be light transmitting. For example, the housing 12 may be formed by attaching the lens 14 to an opaque lower portion 16. The lower portion 16 could be formed from a single part, or, as described below, can be formed from multiple parts that collectively partially define the housing 12.

Figure 2:
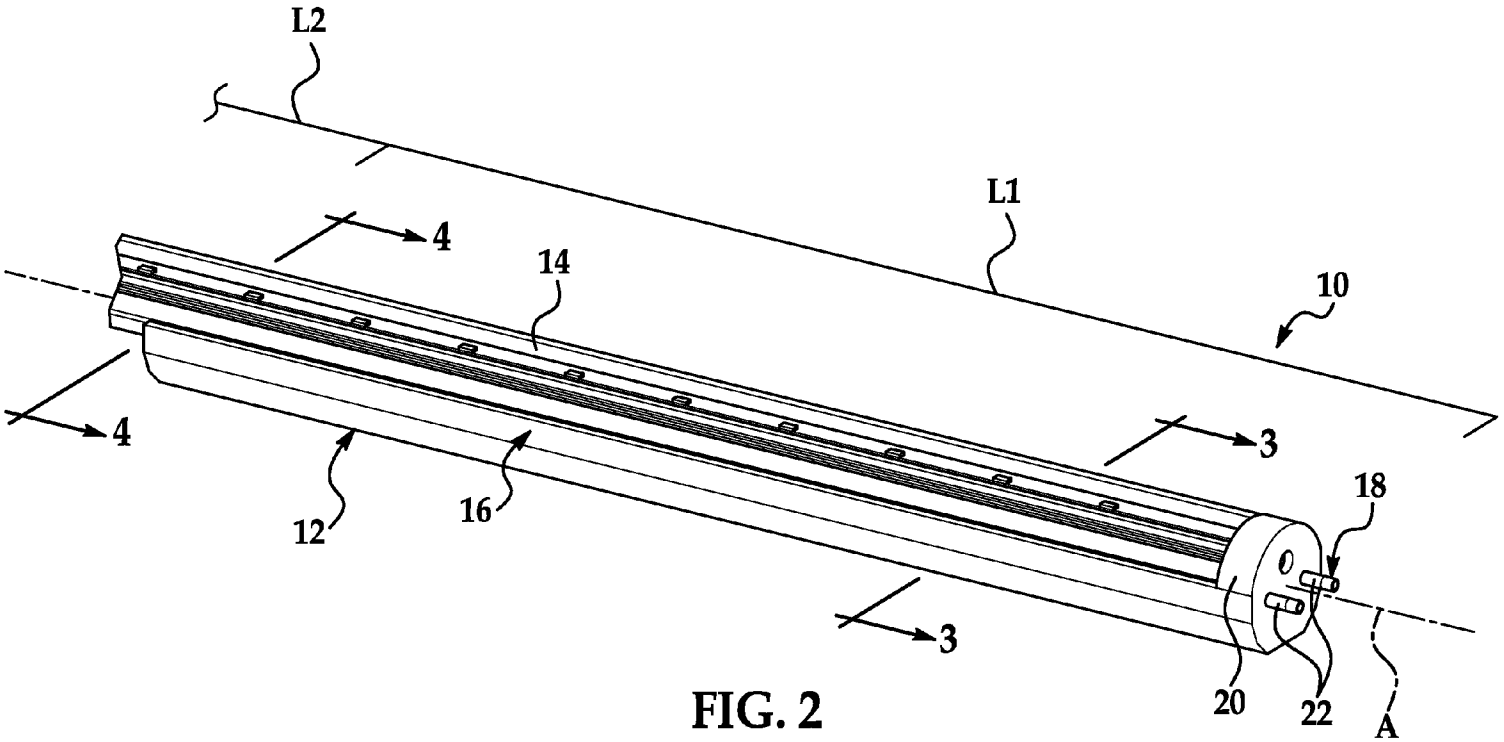
FIG. 2 is a partial perspective view of the LED-based light of FIG. 1.

With continued reference to FIG. 2, the LED-based light 10 can include an electrical connector 18 positioned at an end of the housing 12. In the illustrated example, the electrical connector 18 is a bi-pin connector carried by an end cap 20. A pair of end caps 20 can be attached at opposing longitudinal ends of the housing 12 for physically connecting the LED-based light 10 to a fluorescent light fixture. The end caps 20 can be the sole physical connection between the LED-based light 10 and the fixture. At least one of the end caps 20 can additionally electrically connect the LED-based light 10 to the fixture to provide power to the LED-based light 10. Each end cap 20 can include two pins 22. Two of the total four pins may be configured as bi-pin electrical connector 18 and the other two pins can be "dummy pins" that provide physical but not electrical connection to the fixture. Bi-pin electrical connector 18 is compatible with variously configured fluorescent fixtures, although other types of electrical connectors can be used, such as single pin connector or screw type connector.

The housing 12 of the LED-based light 10 is generally defined by the lens 14 and the lower portion 16 opposing the lens 14 as it extends a length along the longitudinal axis A. The cross section of the housing 12 at a point along the longitudinal axis A is likewise circumferentially defined by the lens 14 and the lower portion 16 opposing the lens 14. The housing 12 can have a cross sectional shape that varies at different points along the longitudinal axis A. For example, the housing 12 may include the lens 14 having a generally constant outer profile extending along the longitudinal axis A, and the lower portion 16 having a cross sectional shape that varies along the longitudinal axis A, such that the housing 12, circumferentially defined partially by the lens 14 and partially by the lower portion 16 opposing the lens 14, is an elongated housing 12 having a varying cross section along the longitudinal axis A.

Other configurations for the lens 14 and/or lower portion 16 could be used to define the housing 12. For example, the lens 14 could have a cross sectional shape that varies along the longitudinal axis A, with the lower portion 16 having a generally constant cross sectional shape along the longitudinal axis A. Or, both the lens 14 and the lower portion 16 could have cross sectional shapes that vary along the longitudinal axis A. Alternatively, the housing 12 could include components other than lens 14 and the lower portion 16 that function to define, either alone or in some combination with the lens 14 and/or lower portion 16, a housing 12 with a cross sectional shape that varies at different points along the longitudinal axis A.

Figure 3:
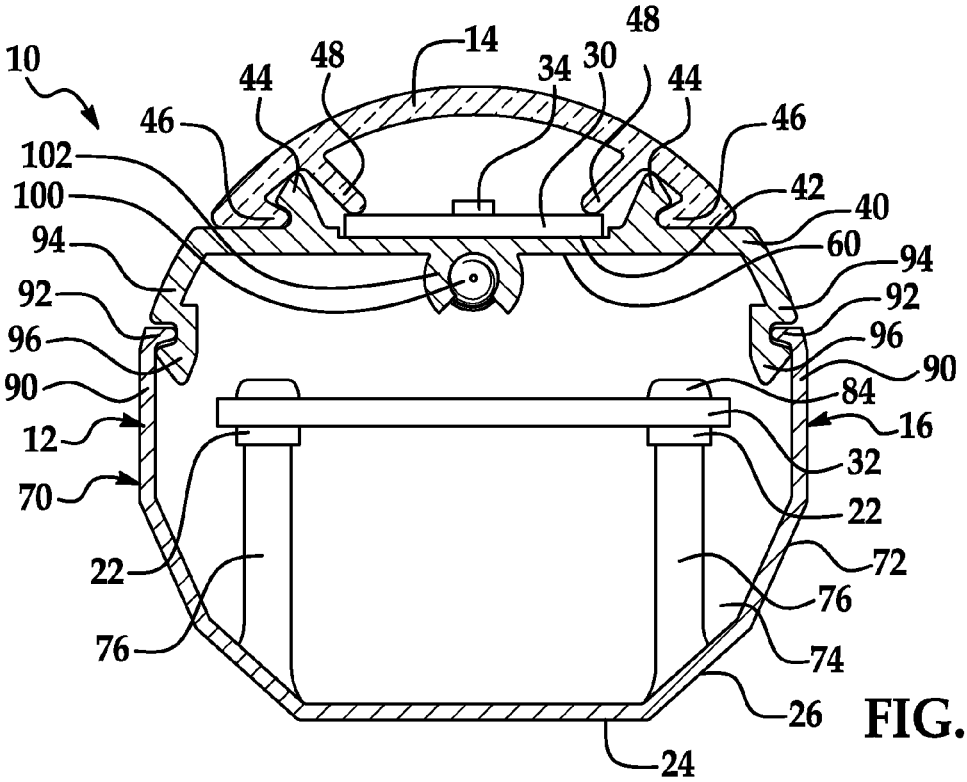
FIGS. 3 and 4 are section views of the LED-based light of FIG. 1.
Figure 4:
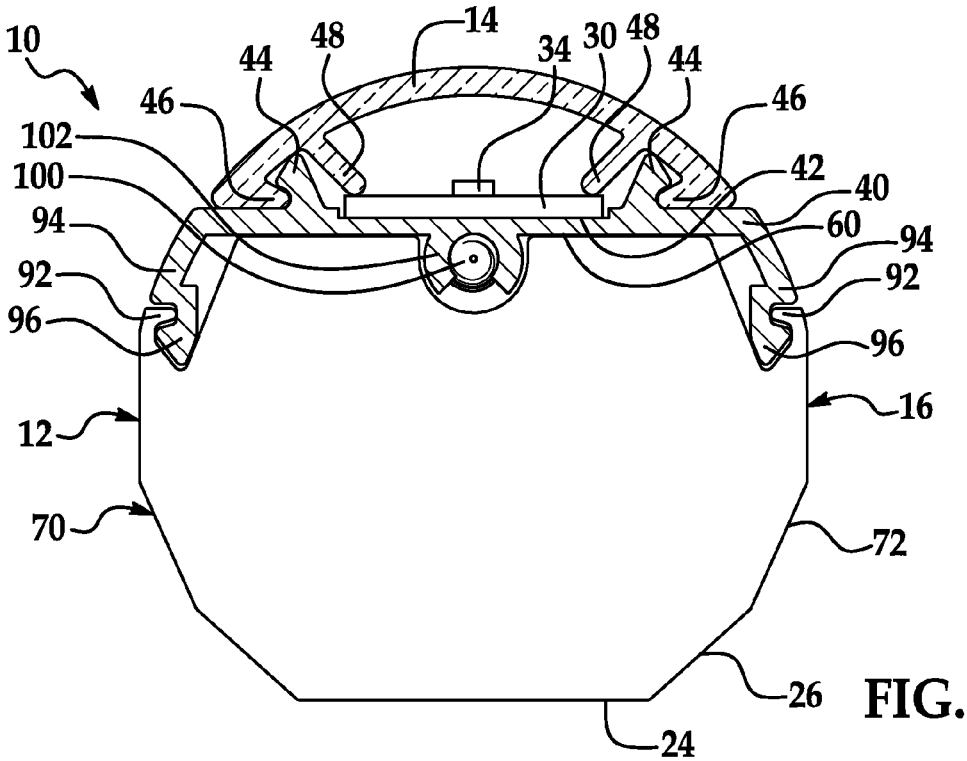

Exemplary cross sections of the housing 12 along the longitudinal axis A are illustrated in FIGS. 3 and 4. The cross section of the LED-based light 10 at a portion along the first partial length L1 of the housing 12 is taken along the line 3-3 of FIG. 2 and illustrated in FIG. 3. As illustrated in FIG. 3, along the first partial length L1, the lens 14 has an arcuate cross section, and the lower portion 16 opposing the lens 14 has a substantially C-shaped cross section, such that that the housing 12 has a substantially circular cross section along the first partial length L1 of the housing 12. The substantially circular cross section could be curvilinear, or as shown in FIG. 3, could be defined by the housing 12 including one or more flat surfaces, for instance, a number of adjoining flat longitudinally extending surfaces, such as the exemplary surfaces 24 and 26.

The cross section of the LED-based light 10 at a portion along the second partial length L2 of the housing 12 is taken along the line 4-4 of FIG. 2 and illustrated in FIG. 4. As shown in FIG. 4, the cross section of the housing 12 along the second partial length L2 is different from the cross section of the housing 12 along the first partial length L1. That is, while the housing 12 has a substantially circular cross section along the first partial length L1, the housing 12 has a non-circular cross section along the second partial length L2. The illustrated lens 14 has a generally constant arcuate cross section along the length of the housing 12, including both the first partial length L1 and second partial length L2. Along the second partial length L2, the lower portion 16 opposing the arcuate lens 14 has a substantially flat cross section, such that that the housing 12 has a generally bow-shaped cross section along the second partial length L2 of the housing 12.

Figure 5:
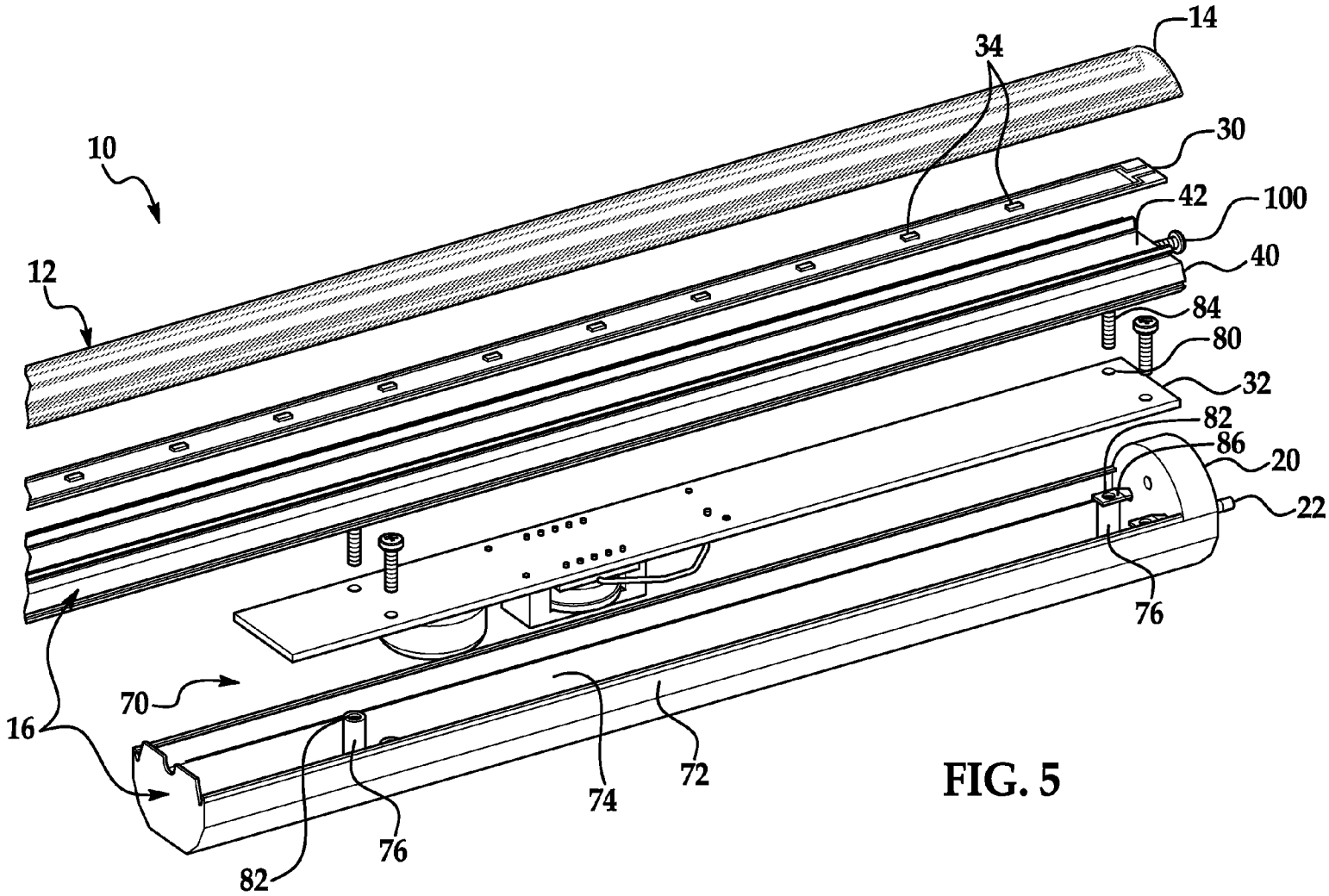
FIG. 5 is an exploded partial perspective view of the LED-based light of FIG. 1 showing a power supply assembly.

With reference to FIGS. 3-5, the housing 12 of the LED-based light 10 can house a number of components. For example, one or more circuit boards 30 and 32 are illustrated as supported within the housing 12. The circuit board 30 can be an LED circuit board having at least one LED circuit. The LED circuit board 30 can include at least one LED 34, a plurality of series-connected or parallel-connected LEDs 34, an array of LEDs 34 or any other arrangement of LEDs 34. Each of the LEDs 34 can include a single diode or multiple diodes, such as a package of diodes producing light that may appear to an ordinary observer as coming from a single source. The LEDs 34 can be surface-mount devices of a type available from Nichia, although other types of LEDs can alternatively be used. For example, the LED-based light 10 can include high-brightness semiconductor LEDs, organic light emitting diodes (OLEDs), semiconductor dies that produce light in response to current, light emitting polymers, electro-luminescent strips (EL) or the like.

The LEDs 34 may emit white light or light having a range of wavelengths. LEDs that emit blue light, ultra-violet light or other wavelengths of light can be used in place of or in combination with white light emitting LEDs 34. The number, spacing and orientation of the LEDs 34 can be a function of a length of the LED-based light 10, a desired lumen output of the LED-based light 10, the wattage of the LEDs 34 and/or the viewing angle of the LEDs 34. For a 48" LED-based light 10, for example, the number of LEDs 34 may vary from about thirty to sixty such that the LED-based light 10 outputs approximately 3,000 lumens. However, a different number of LEDs 34 can alternatively be used, and the LED-based light 10 can output any other amount of lumens. The LEDs 34 can be evenly spaced along the LED circuit board 30 and arranged on the LED circuit board 30 to substantially fill a space along a length of the lens 14 between end caps 20 positioned at opposing longitudinal ends of the housing 12. Alternatively, single or multiple LEDs 34 can be located at one or both ends of the LED-based light 10. The LEDs 34 can be arranged in a single longitudinally extending row along a central portion of the LED circuit board 30, for example, as shown in FIG. 2, or can be arranged in a plurality of rows or arranged in groups. The spacing of the LEDs 34 can be determined based on, for example, the light distribution of each LED 34 and the number of LEDs 34.

The circuit board 32 can be a power supply circuit board. The power supply circuit board 32 has power supply circuitry configured to condition an input power received from, for example, the fixture through the electrical connector 18 to a power usable by and suitable for the LEDs 34. In some implementations, the power supply circuit board 32 can include one or more of an inrush protection circuit, a surge suppressor circuit, a noise filter circuit, a rectifier circuit, a main filter circuit, a current regulator circuit and a shunt voltage regulator circuit. The power supply circuit board 32 can be suitably designed to receive a wide range of currents and/or voltages from a power source and convert them to a power usable by the LEDs 34.

The LED circuit board 30 and the power supply circuit board 32 are illustrated as elongate printed circuit boards. Multiple circuit board sections can be joined by bridge connectors to create the circuit boards 30 and 32. Also, other types of circuit boards may be used, such as a metal core circuit board. Or, instead of the circuit boards 30 and 32, other types of electrical connections (e.g., wires) can be used to electrically connect the LEDs 34 to a power source.

Both the LED circuit board 30 and the power supply circuit board 32 can be positioned to extend along the longitudinal axis A of the LED-based light 10. With continued reference to FIG. 5, the LED circuit board 30 can have a length different from a length of the power supply circuit board 32. For example, the LED circuit board 30 can generally extend the length of the housing 12, and the power supply circuit board 32 can extend a partial length of the housing 12, for instance, the first partial length L1 of the housing 12.

The LED circuit board 30 may be a separate component from the power supply circuit board 32, and the LED circuit board 30 can be housed separately from the power supply circuit board 32. The LED circuit board 30 is positioned adjacent the lens 14, such that the LEDs 34 included in the LED circuit board 30 are oriented to illuminate the lens 14. The power supply circuit board 32 can be housed elsewhere within the housing 12 of the LED-based light 10, for example, within a cavity defined by the lower portion 16.

The LED-based light 10 can include features for supporting the circuit boards 30 and 32 within the housing 12, and/or for supporting other components of the LED-based light 10. For example, the LED-based light 10 can include an elongate base 40. The elongate base 40 can extend the length of the housing 12 and include an LED mounting surface 42 for supporting the LED circuit board 30 within the housing 12 adjacent the lens 14. The LED mounting surface 42 may be substantially flat, so as to engage a flat underside of the LED circuit board 30 opposite the LEDs 34.

The elongate base 40 can be further configured for attachment with the lens 14. For example, the elongate base 40 may include a pair of hooked projections 44 for retaining a corresponding pair of respective projections 46 of the lens 14. The projections 46 of the lens 14 can be slidably engaged with the hooked projections 44 of the elongate base 40, or can be snap fit to the hooked projections 44. The hooked projections 44 can be formed integrally with the elongate base 40 by, for example, extruding the elongate base 40 to include the hooked projections 44. Similarly, the projections 46 can be formed integrally with the lens 14 by, for example, extruding the lens 14 to include the projections 46. The hooked projections 44 and projections 46 can extend the longitudinal lengths of the elongate base 40 and the lens 14, respectively, although a number of discrete hooked projections 44 and/or projections 46 could be used to couple the lens 14 to the elongate base 40. Alternatively, the elongate base 40 could be otherwise configured for attachment with the lens 14. For example, the lens 14 could be clipped, adhered, snap- or friction-fit, screwed or otherwise attached to the elongate base 40.

The lens 14 can include one or more structures for securing the LED circuit board 30 within the housing 12 of the LED-based light 10. For example, lens 14 may include tabs 48 for securing the LED circuit board 30 to the LED mounting surface 42 of the elongate base 40. The tabs 48 are illustrated as projecting from the lens 14 at an angle towards the LED circuit board 30 to contact the LED circuit board 30 along its longitudinal length and prevent disengagement of the LED circuit board 30 from the LED mounting surface 42. The tabs 48 can be formed integrally with the lens 14 by, for example, extruding the lens 14 to include the tabs 48. Each of the tabs 48 can extend a longitudinal length of the lens 14, although a number of discrete tabs 48 could be included along the longitudinal length of the lens 14 to secure the LED circuit board 30 to the LED mounting surface 42 of the elongate base 40. Although the tabs 48 are illustrated as projecting at an angle from the lens 14, the tabs 48 could alternatively project at other angles and/or from other structures within the LED-based light 10, for example from the elongate base 40. In addition to or as an alternative to the tabs 48, the LED circuit board 30 could be secured within the housing 12 through slidable engagement with one or more structures of the LED-based light 10, such as the end cap 20, or the LED circuit board 30 could alternatively be clipped, adhered, snap- or friction-fit, screwed or otherwise secured within the housing 12.

The illustrated elongate base 40 further includes a surface 60 opposite the LED mounting surface 42 and opposing the lens 14. The surface 60 is shown as a substantially flat surface, but could have other geometries, and can include structures for coupling with other components of the LED-based light 10. The surface 60 may form a part of the lower portion 16 of the housing 12 for the LED-based light 10 along a partial length of the housing 12. For example, the surface 60 can form a part of the lower portion 16 of the housing 12 along the second partial length L2 of the housing 12. When the surface 60 of the elongate base 40 is positioned to oppose the lens 14 with a substantially arcuate cross section, the housing 12 has the generally bow-shaped cross section shown in FIG. 4 along the second partial length L2.

The LED-based light 10 can include one or more highly thermally conductive structures for enhancing heat dissipation. For instance, the elongate base 40 could be configured as a heat sink. The elongate base 40 can be constructed from a thermally conductive material for thermally coupling the LEDs 34 to an ambient environment surrounding the LED-based light 10. The elongate base 40 may form the LED mounting surface 42, which can be configured for thermal coupling to the LEDs 34. In the LED-based light 10, for example, the LED mounting surface 42 is thermally coupled to the LEDs 34 through the LED circuit board 30, although the LEDs 34 could be otherwise thermally coupled to the LED mounting surface 42. The LED mounting surface 42 may be substantially flat, so as to engage a flat underside of the LED circuit board 30 in a thermally conductive relation. The elongate base 40 can define a heat transfer path from the LED mounting surface 42 to the surface 60, which can be configured as a heat dissipating surface for dissipating heat generated by the LEDs 34 during operation to the ambient environment surrounding the LED-based light 10. The surface 60 may be the substantially flat surface 60, although the surface 60 could alternatively include other geometries and/or structures for increasing the surface area of the surface 60, such as bends, fins or other projections.

The elongate base 40 can also be configured to support the power supply circuit board 32 within the housing 12 of the LED-based light 10. For example, the elongate base 40 of the LED-based light 10 can be configured for attachment to a power supply assembly 70 including the power supply circuit board 32. The power supply assembly 70 may generally include power supply circuitry configured to condition an input power received from a fixture or other power supply to a power usable to operate the LEDs 34. The power supply circuitry for the LED-based light 10 may be included in the power supply circuit board 32.

The power supply assembly 70 may include a cover 72 for housing and enclosing the power supply circuit board 32. The cover 72 defines a hollow cavity 74 for housing the power supply circuit board 32, and can be configured to support the power supply circuit board 32 within the cavity 74. In addition, the cover 72 can include structures for selectively and/or releasably attaching the power supply circuit board 32 to the cover 72. Various means of attachment can be used for selectively and/or releasably attaching the power supply circuit board 32 to the cover 72. In the illustrated example, the cover 72 includes a plurality of posts 76 generally forming a platform for supporting the power supply circuit board 32 within the cavity 74 of the cover 72. The power supply circuit board 32 can define one or more apertures 80 positioned for alignment with corresponding apertures 82 defined by the post (one representative aperture 80 and one representative aperture 82 are indicated with respective reference numerals). The apertures 80 are defined adjacent corners of the power supply circuit board 32, but could be positioned elsewhere on the power supply circuit board 32. The apertures 80 defined by the power supply circuit board 32 can be sized to receive a threaded fastener 84, and the apertures 82 defined by the posts 76 can be configured for threadedly receiving the threaded fastener 84 to attach the power supply circuit board 32 to the cover 72. The power supply circuit board 32 could alternatively be supported within the cover 72 through slidable engagement with a part of the cover 72, or the power supply circuit board 32 could be clipped, adhered, snap- or friction-fit, screwed or otherwise coupled to the cover 72.

The power supply assembly 70 can also include an electrical connection to electrically couple the power supply circuit board 32 to the electrical connector 18 (see for example, FIG. 2) configured to electrically connect the LED-based light 10 to a fixture in order to provide power to the LED-based light 10. For example, one or more of the threaded fasteners 84 adjacent an end cap 20 can be electrically conductive and be used to provide an electrical connection between the power supply circuitry included in the power supply circuit board 32 and one or more of the pins 22 of the end cap 20. Referring to FIG. 5, two pins 22 extend through the end cap 20 to the hollow cavity 74 enclosed by the cover 72. The portion of the pins 22 extending through the end cap 20 can define pin apertures 86 positioned generally in alignment with corresponding apertures 80 and 82 respectively defined by the power supply circuit board 32 and the posts 76. Each of the pin apertures 86 can be sized to receive a threaded fastener 84. Further, the pin apertures 86 and the apertures 80 defined by the power supply circuit board 32 can be sized to engage the threaded fastener 84 in electrically conductive relation, such that a pin 22 and the power supply circuitry include in the power supply circuit board 32 are electrically connected through the threaded fastener 84.

The power supply assembly 70 could be included in the LED-based light 10 by integrally forming the cover 72 with the elongate base 40, for example. In the illustrated exemplary implementation of the LED-based light 10, the power supply assembly 70 is releasably coupled to the LED-based light 10. The power supply assembly 70 may be a modular component that can be selectively and releasably attached to the LED-based light 10.

The cover 72 of the power supply assembly 70 may be configured for selective and releasable attachment to the elongate base 40 of the LED-based light 10. The cover 72 may be generally C-shaped, with opposing longitudinally extending side walls 90 terminating at a respective pair of terminal edges forming projections 92. The surface 60 of the elongate base 40 may include a pair of opposing flanges 94 extending from the longitudinal edges of the surface 60 in a direction away from the lens 14, and each flange 94 forms a hooked projection 96 for retaining a corresponding projection 92 of the cover 72. The projections 92 of the cover 72 can be slidably engaged with the hooked projections 96 of the elongate base 40, or can be snap fit to the hooked projections 96. The hooked projections 96 can be formed integrally with the elongate base 40 by, for example, extruding the elongate base 40 to include the flanges 94 with hooked projections 96. Similarly, the projections 92 can be formed integrally with the cover 72 by, for example, extruding the cover 72 to include the projections 92. The hooked projections 96 and projections 92 can extend the longitudinal lengths of the elongate base 40 and the cover 72, respectively, although a number of discrete hooked projections 96 and/or projections 72 could be used to couple the cover 72 to the elongate base 40. Alternatively, the cover 72 could be otherwise configured for attachment to the elongate base 40. For example, the cover 72 could be configured to be clipped, adhered, snap- or friction-fit, screwed or otherwise attached to the elongate base 40.

The cover 72 can be enclosed at each longitudinal end. For example, the cover 72 may be enclosed at a longitudinal end adjacent a longitudinal end of the housing 12 by the end cap 20. The cover 72 can be integral with the end cap 20, or the cover 72 and the end cap 20 could be separate components, with a longitudinal end of the cover 72 sized to abut the end cap 20. The illustrated end cap 20 can be affixed to the housing 12 by threadedly engaging a threaded fastener 100 through the end cap 20 and into a groove 102 formed in the elongate base 40. The groove 102 extends from the surface 60 of the elongate base 40, but could alternatively extend from other portions of the elongate base 40 or from other components of the housing 12. The end cap 20 could alternatively be clipped, adhered, snap- or friction-fit, screwed or otherwise attached to the elongate base 40. The illustrated cover 72 is integral with the end cap 20, and affixation of the end cap 20 to the elongate base 40 secures the cover 72 to the LED-based light 10.

The elongate base 40 includes the surface 60, which may form at least a part of the lower portion 16 of the housing 12 of the LED-based light 10. Absent attachment of the power supply assembly 70, for example, the surface 60 could form substantially the entire lower portion 16 of the housing 12, such that the cross section of the housing 12 is generally defined by the lens 14 and by the surface 60 of the elongate base 40 positioned to oppose the lens 14. When attached to the elongate base 40, the cover 72 of the power supply assembly 70 encloses a part of the surface 60 of the elongate base 40 to form at least a part of the lower portion 16 of the housing 12. When attached to the elongate base 40 in this manner, the cross section of the housing 12 along the length of the cover 72 is generally defined by the lens 14 and by the cover 72 positioned to oppose the lens 14. The cover 72 may extend the first partial length L1 of the housing 12, such that the lower portion 16 of the housing 12 is defined by the lens 14 and by the cover 72 positioned to oppose the lens 14 along the first partial length L1 of the housing 12. Along the second partial length L2 of the housing 12 not including the cover 72, the lower portion 16 of the housing 12 is defined by the lens 14 and by the surface 60 of the elongate base 40 positioned to oppose the lens 14.

The surface 60 and the cover 72 could have the same or similar geometries, although the surface 60 and the cover 72 of the LED-based light 10 can have differing geometries. The surface 60 may be configured as a substantially flat surface, including the opposing flanges 94 extending from the longitudinal edges of the surface 60, as well as the groove 102. When the substantially flat surface 60 is positioned to oppose the lens 14 with a substantially arcuate cross section, the housing 12 has the generally bow shaped cross section shown in FIG. 4 along the second partial length L2.

The cover 72 may have a substantially C-shaped cross section. The substantially C-shaped cross section of the cover 72 could be curvilinear, or as shown in FIG. 3, could include one or more flat surfaces, for instance, a number of adjoining flat longitudinally extending surfaces, such as the exemplary surfaces 24 and 26. The lower portion 16 of the housing 12 can be entirely defined by the substantially C-shaped cover 72 along the first partial length L1 of the housing 12, or the flanges 94 of the elongate base 40 can also form a contiguous portion of the lower portion 16 of the housing 12 along the first partial length L1 of the housing 12. When the substantially C-shaped cover 72 is positioned to oppose the lens 14 with a substantially arcuate cross section, the housing 12 has the substantially circular cross section shown in FIG. 3 along the first partial length L1.

The surface 60 and/or the cover 72 can have various geometries other than those shown in the figures and described herein. For example, the surface 60 could include arcuate or polygonal geometries. The surface 60 could also include structures for coupling with other components of the LED-based light 10, or could include structures for heat dissipation, for example. The addition of such structures could result in a surface 60 that remains substantially flat, or could result in a surface 60 that is not substantially flat. The surface 60 can extend a length of the housing 12, or, for example, could terminate at a point adjacent the cover 72. For the illustrated surface 60 extending a length of the housing 12, the exposed geometry of the surface 60 could be different from the geometry of the surface 60 enclosed by the cover. 72. The cover 72 could additionally have alternative geometries. The illustrated cover 72 includes, as a non-limiting example, a larger flat surface 24 at its apex compared to the exemplary surface 26 forming a portion of the side walls of 90 of the cover 72. The flat surface 24 could alternatively be enlarged, for example, to form a cover 72 with a substantially D-shaped cross section.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An LED-based light for replacing a fluorescent light in a light fixture, comprising:

an elongate base defining a first surface and an opposing second surface;

an LED circuit board supported on the first surface of the base, the LED circuit board including at least one LED;

a light transmitting lens attached to the base to enclose the LED-circuit board, the lens extending a substantial length of the base;

a power supply circuit board located adjacent the second surface of the base, the power supply circuit board configured to supply power to the at least one LED; and a cover attached to the base to enclose the power supply circuit board, the cover extending only a partial length of the base, wherein the base, the lens and the cover comprise a housing for the LED-based light, and wherein a perimeter of the housing is defined substantially by the lens and the cover along a first longitudinal portion of the housing, and substantially by the lens and the second surface of the base along a second longitudinal portion of the housing.

2. The LED-based light of claim 1, wherein the first longitudinal portion has a first cross section and the second longitudinal portion has a second cross section, and wherein a shape of the first cross section is different from a shape of the second cross section, such that the housing includes a geometric asymmetry about a plane that is normal to a longitudinal axis of the housing and that passes through a midpoint of the housing.

3. The LED-based light of claim 1, wherein the lens is arcuate and the cover is substantially C-shaped, such that the first longitudinal portion has a substantially circular shaped cross section.

4. The LED-based light of claim 1, wherein the lens is arcuate and the second surface of the base is substantially flat, such that the second longitudinal portion has a substantially bow shaped cross section.

5. The LED-based light of claim 1, wherein the first longitudinal portion adjoins the second longitudinal portion.

6. The LED-based light of claim 1, further comprising:

a connector at and end of the housing configured for connection to a light fixture.

7. The LED-based light of claim 1, further comprising:

a power supply assembly, the power supply assembly including the power supply circuit board and the cover, wherein the power supply assembly is selectively removably attached to the base.

8. An LED-based light for replacing a fluorescent light in a light fixture, comprising:

an elongate base;

an LED circuit board supported on the base, the LED circuit board including at least one LED;

a light transmitting lens attached to the base to enclose the LED-circuit board; and a power supply assembly, the power supply assembly including power supply circuitry configured to supply power to the at least one LED, and a cover enclosing the power supply circuitry, the cover extending only a partial length of the base, wherein the base, the lens and the cover comprise a housing for the LED-based light, and wherein a perimeter of the housing is defined substantially by the lens and the cover along a first longitudinal portion of the housing, and substantially by the lens and the base along a second longitudinal portion of the housing.

9. The LED-based light of claim 8, the power supply assembly further comprising:

a connector configured for physical and electrical connection to a light fixture, the connector in electrical communication with the power supply circuitry.

10. The LED-based light of claim 8, wherein the lens is arcuate, and the cover is substantially C-shaped, such that the first longitudinal portion has a substantially circular shaped cross section, and wherein the base is substantially flat, such that the second longitudinal portion has a substantially bow shaped cross section.

11. The LED-based light of claim 8, wherein the lens is arcuate and the cover is substantially C-shaped, such that the first longitudinal portion has a substantially circular shaped cross section.

12. The LED-based light of claim 8, wherein the lens is arcuate and the base is substantially flat, such that the second longitudinal portion has a substantially bow shaped cross section.

13. The LED-based light of claim 8, wherein the first longitudinal portion adjoins the second longitudinal portion.

14. The LED-based light of claim 8, further comprising:

a connector at and end of the housing configured for connection to a light fixture.

15. The LED-based light of claim 8, wherein the power supply assembly is selectively removably attached to the base.

* * * * *